US012590579B2

(12) United States Patent
Chou et al.

(10) Patent No.: US 12,590,579 B2
(45) Date of Patent: Mar. 31, 2026

(54) PORTABLE BLOWING AND SUCTION AIR COMPRESSOR

(71) Applicant: UNIK WORLD INDUSTRIAL CO., LTD., Tainan City (TW)

(72) Inventors: Wen San Chou, Tainan City (TW); Cheng Hsien Chou, Tainan City (TW)

(73) Assignee: UNIK WORLD INDUSTRIAL CO., LTD., Tainan City (TW)

( * ) Notice: Subject to any disclaimer, the term of this patent is extended or adjusted under 35 U.S.C. 154(b) by 37 days.

(21) Appl. No.: 18/746,060

(22) Filed: Jun. 18, 2024

(65) Prior Publication Data

US 2025/0369437 A1 Dec. 4, 2025

(30) Foreign Application Priority Data

Jun. 3, 2024 (TW) ..... 113120437

(51) Int. Cl.
*F04B 53/14* (2006.01)
*F04B 39/00* (2006.01)
(Continued)

(52) U.S. Cl.
CPC ..... *F04B 53/145* (2013.01); *F04B 39/0022* (2013.01); *F04B 53/143* (2013.01);
(Continued)

(58) Field of Classification Search
CPC .. F04B 35/06; F04B 39/0005; F04B 39/0022; F04B 53/143–145
See application file for complete search history.

(56) References Cited

U.S. PATENT DOCUMENTS 2,372,472 A * 3/1945 Campbell ..... F16C 7/04 123/78 E
6,057,608 A * 5/2000 Bailey, Jr. ..... H01M 50/202 307/64
(Continued)

FOREIGN PATENT DOCUMENTS

CN 201363415 12/2009
DE 102012024121 6/2014
(Continued)

OTHER PUBLICATIONS

Machine translation of JP H11-141462A, accessed on Oct. 17, 2025. (Year: 2025).*
(Continued)

*Primary Examiner* — Jonathan R Matthias
(74) *Attorney, Agent, or Firm* — JCIPRNET

(57) ABSTRACT

A portable blowing and suction air compressor including a motor, a piston having first and second ends opposite to each other, a sealing member, a cylinder, and first and second check valves is disclosed. The first end is connected to the motor, the sealing member is sheathed onto the second end, and the second end is movably coupled to an inner wall of the cylinder. The second end leans against the inner wall through the sealing member. A cross section of the sealing member generates multiple contact zones on the inner wall. A recess is formed between two adjacent contact zones. The cylinder has an air inlet pipe and an air outlet pipe connected to an inner space of the cylinder and to an exterior environment respectively. The first check valve is disposed in the air inlet pipe, and the second check valve is disposed in the air outlet pipe.

9 Claims, 14 Drawing Sheets

(51) Int. Cl.
*F04B 35/06* (2006.01)
*F04B 39/10* (2006.01)

(52) U.S. Cl.
CPC ..... *F04B 35/06* (2013.01); *F04B 39/0005* (2013.01); *F04B 39/102* (2013.01)

(56) References Cited

U.S. PATENT DOCUMENTS

| | | | | |
|---|---|---|---|---|
| 7,908,962 | B2 * | 3/2011 | Kim | F04B 39/0005 92/84 |
| 2002/0043153 | A1 * | 4/2002 | An | F04B 39/0022 92/60 |
| 2008/0181794 | A1 | 7/2008 | Steinfels et al. | |
| 2008/0181800 | A1 * | 7/2008 | Muschalek | F04B 45/04 417/470 |
| 2008/0311795 | A1 * | 12/2008 | Brotto | H01M 50/244 439/628 |
| 2022/0074399 | A1 | 3/2022 | Narisawa et al. | |

FOREIGN PATENT DOCUMENTS

| | | | |
|---|---|---|---|
| DE | 102017011438 | | 6/2019 |
| JP | S5641175 | | 4/1981 |
| JP | S6087379 | U | 6/1985 |
| JP | H11141462 | | 5/1999 |
| JP | H11336908 | | 12/1999 |
| JP | 2005344570 | A | 12/2005 |
| JP | 2008275021 | | 11/2008 |
| JP | 2012112282 | | 6/2012 |
| JP | 2012197908 | | 10/2012 |
| JP | 2013133055 | | 7/2013 |
| JP | 2013209988 | | 10/2013 |
| JP | 2022118107 | | 8/2022 |
| JP | 2024006587 | | 1/2024 |
| KR | 20020029549 | A | 4/2002 |
| TW | 505196 | | 10/2002 |
| TW | M661985 | | 10/2024 |

OTHER PUBLICATIONS

Machine translation of DE 102012024121 A1, accessed on Oct. 17, 2025. (Year: 2025).*

"Office Action of Taiwan Counterpart Application", issued on Dec. 4, 2024, p. 1-p. 8.

"Office Action of Germany Counterpart Application", issued on Mar. 28, 2025, with English translation thereof, p. 1-p. 9.

"Notice of Reasons for Refusal of Japan Counterpart Application", issued on Jul. 16, 2025, p. 1-p. 3.

"Office Action of Korea counterpart Application", issued on Nov. 18, 2025, p. 1-p. 6.

Hideo Ohshi, "Fluid Machinery", The university of Tokyo, Published by Hiyoshi Publishing (Kijukan), Aug. 25, 1994.

* cited by examiner

PORTABLE BLOWING AND SUCTION AIR COMPRESSOR

CROSS-REFERENCE TO RELATED APPLICATION

This application claims the priority benefit of Taiwan application serial no. 113120437, filed on Jun. 3, 2024. The entirety of the above-mentioned patent application is hereby incorporated by reference herein and made a part of this specification.

BACKGROUND

Technical Field

This disclosure relates to an air compressor, and in particular to a portable blowing and suction air compressor.

Description of Related Art

An air compressor is a device that can inflate objects to be inflated, and is widely used for inflating air mattresses and tires. In order to improve the portability of the air compressor, it is necessary to adjust the power supply system in addition to trying to reduce its size. For example, the original operation method that requires to be fixed and plugged into an external power supply by a cable is replaced by the operation method that installs the battery directly on the air compressor.

However, due to the advancement and replacement of battery technology, there are concerns about the lack of applicability of both new batteries to old devices and old batteries to new devices.

Furthermore, the aforementioned inflation process is only a part of the stroke of the piston of the air compressor, and therefore it is obvious that it is not possible to show or utilize the movement of the piston of the air compressor as an inflation device only.

SUMMARY

The disclosure provides an air compressor that generates dual-purpose air flow for blowing and suctioning through reciprocating motion of a piston with different check valves, and uses a sealing member to form multiple contact zones with surfaces of components to ensure airtightness of adjacent components.

A portable blowing and suction air compressor of the disclosure includes a motor, a piston, a sealing member, a cylinder, a first check valve, and a second check valve. The piston has a first end and a second end opposite to each other, and the first end is connected to the motor. The sealing member is sheathed on an outer wall of the piston at the second end. The second end of the piston is movably coupled to the cylinder, and the second end is in contact with an inner wall of the cylinder through the sealing member. A cross section of the sealing member forms multiple contact zones on the inner wall and the outer wall respectively, and a recess is formed between two adjacent one of the contact zones. The cylinder has an air inlet pipe and an air outlet pipe connected to an inner space of the cylinder and connected to exterior environment respectively. The first check valve is disposed in the air outlet pipe, and the second check valve disposed in the air inlet pipe. During a first stroke, the piston compresses air in the cylinder, the compressed air drives the first check valve to clear a passage of the air outlet pipe to enter the air outlet pipe, and the compressed air drives the second check valve to block a passage of the air inlet pipe. During a second stroke, the piston reduces air pressure in the cylinder, the compressed air in the air outlet pipe or air in the exterior environment drives the first check valve to block the passage of the air outlet pipe, and the air in the exterior environment or the air in the air inlet pipe drives the second check valve to clear the passage of the air inlet pipe to enter the cylinder through the air inlet pipe Based on the above, the air compressor utilizes the reciprocating motion of the piston in the cylinder with the first check valve and the second check valve to generate the dual effect of blowing and sucking air flow in different pipelines. Furthermore, the sealing member is sheathed on the piston and abutted to the inner wall of the cylinder. Here, the cross section of the sealing member forms multiple contact zones on the inner wall and the outer wall of the piston respectively, and a recess is formed between two adjacent contact zones. In this way, the airtightness between the piston and the inner wall of the cylinder may be increased during piston movement.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate example embodiments of the disclosure and, together with the description, serve to explain the principles of the disclosure.

DESCRIPTION OF THE EMBODIMENTS

Figure 1:
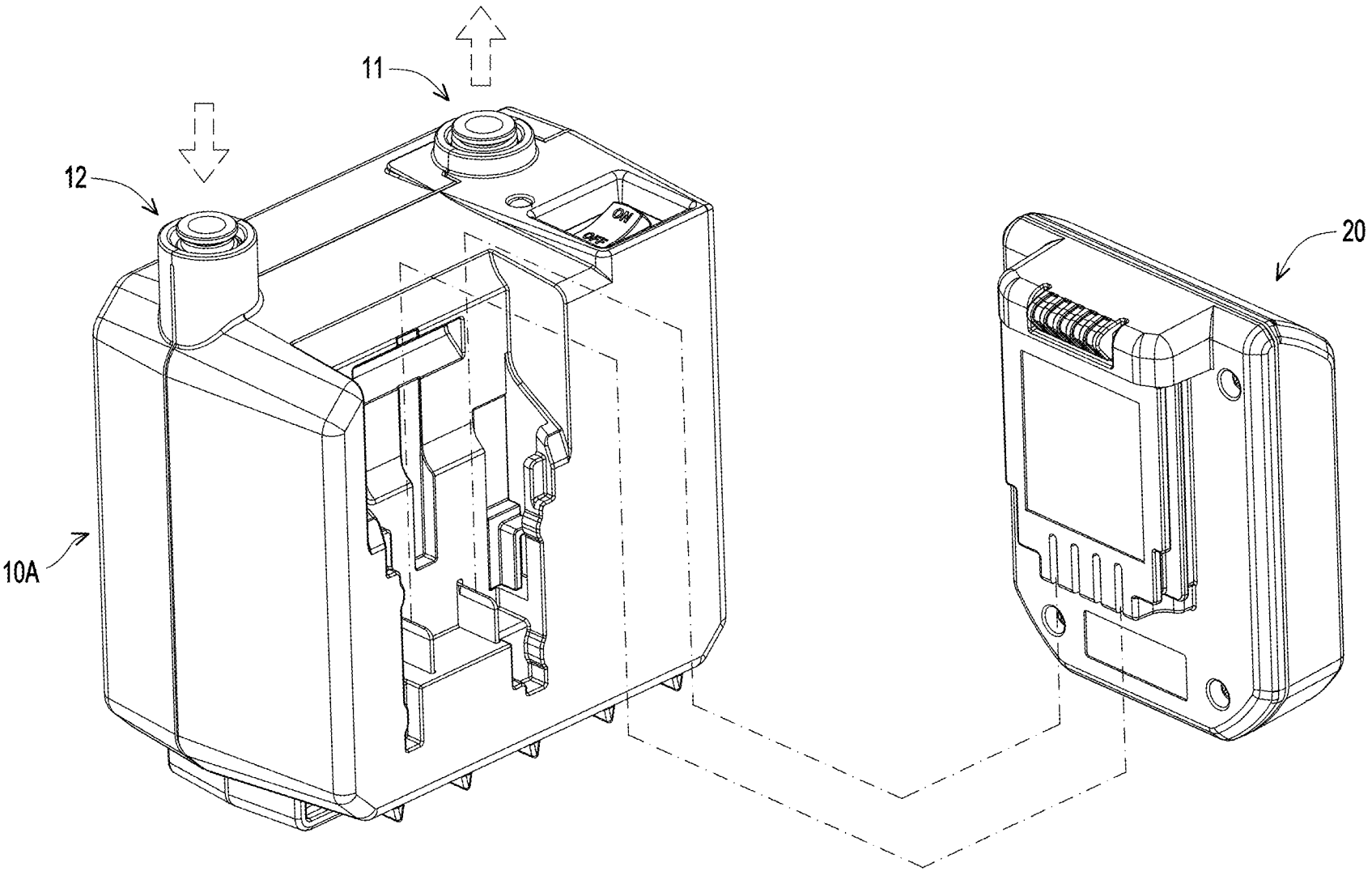
FIG. 1 is a schematic diagram of an air compressor according to an embodiment of the disclosure.
Figure 2:
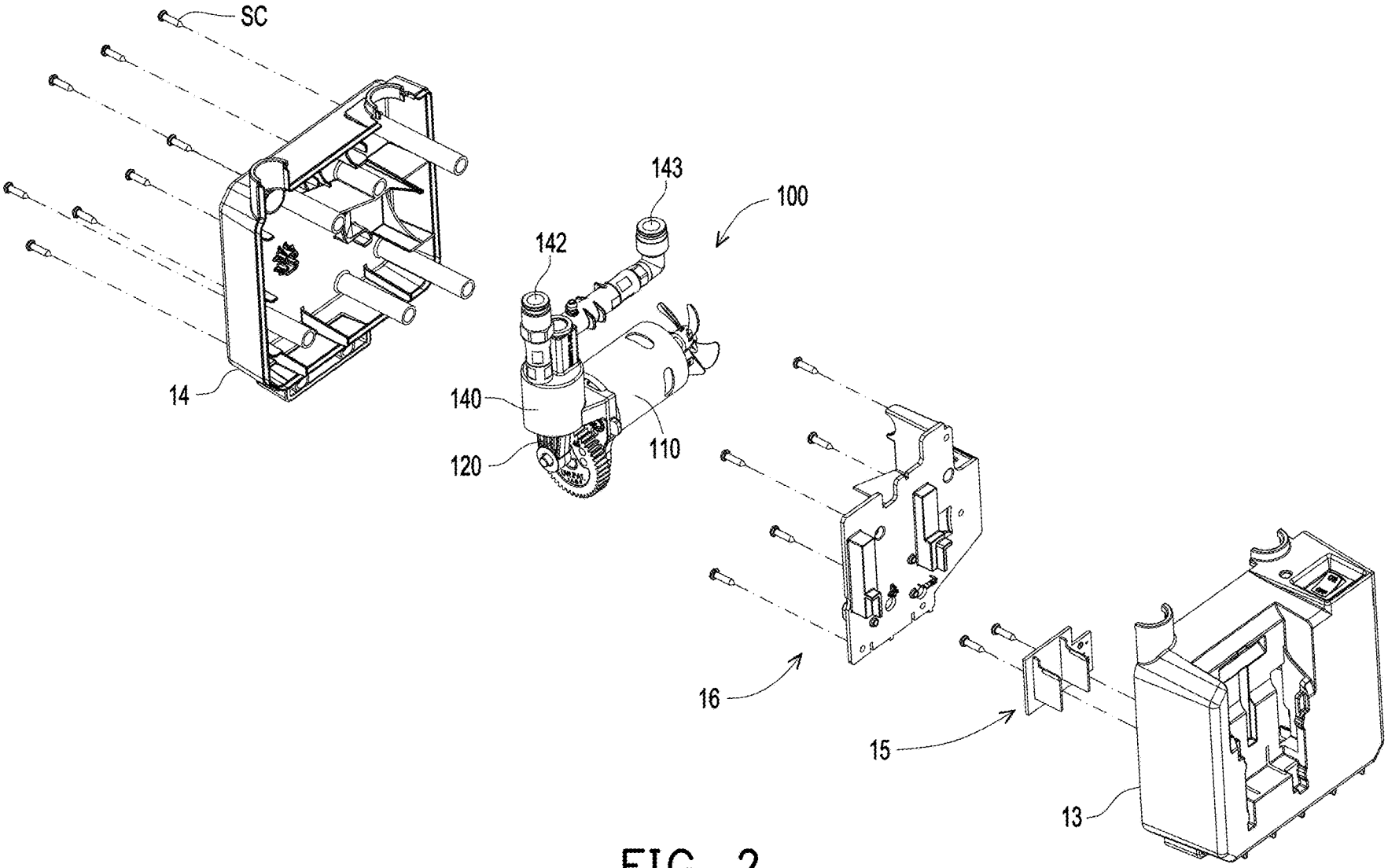
FIG. 2 is an exploded diagram of a main body of the air compressor of FIG. 1.

FIG. 1 is a schematic diagram of an air compressor according to an embodiment of the disclosure. FIG. 2 is an exploded diagram of a main body of the air compressor of FIG. 1. Please refer to FIG. 1 and FIG. 2 at the same time. In this embodiment, an air compressor includes a main body 10A and a battery 20. The battery 20 may be detachably plugged into a slot on the outside of the main body 10A and electrically connected to an electronic module therein to make the air compressor portable without being limited to an external power source that needs to be connected at a fixed location. As shown in FIG. 2, the main body 10A includes housings 13 and 14, a circuit board 15, a partition 16, and an air compressor module 100. These components are assembled together through multiple screws SC, and a cylinder 140 of the air compressor module 100 has an air inlet pipe 142 and an air outlet pipe 143 to facilitate forming an air inlet 12 and an air outlet 11 with the housings 13 and 14.

Figure 3:
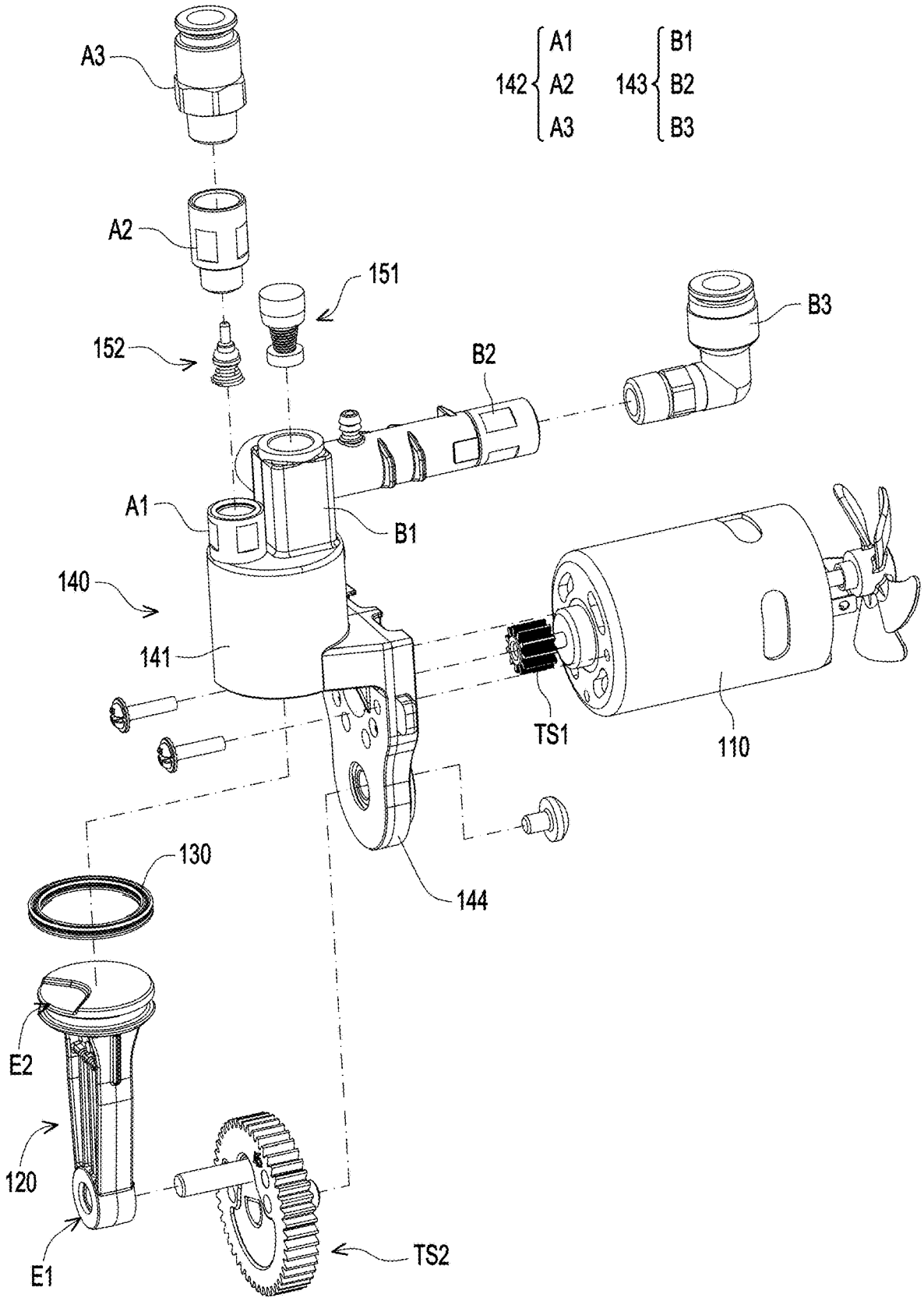
FIG. 3 is an exploded diagram of an air compressor module in FIG. 2.

FIG. 3 is an exploded diagram of an air compressor module in FIG. 2. Please refer to FIG. 3. In this embodiment, the air compressor module 100 includes a motor 110, a piston 120, a sealing member 130, a cylinder 140, a first check valve 151, and a second check valve 152. The piston 120 has a first end E1 and a second end E2 opposite to each other. The first end E1 is connected to the motor 110 through a transmission mechanism. Here, the transmission mechanism includes a first gear TS1 and a second gear TS2. The first gear TS1 is disposed on the motor 110, the second gear TS2 is pivotally mounted on a bracket 144 of the cylinder 140, the second end E2 of the piston 120 is movably coupled in the cylinder 140, and the first end E1 of the piston 120 is pivotally connected to an eccentric position of the second gear TS2. The first gear TS1 passes through the bracket 144 and engages the second gear TS2 as a result of the assembly of the motor 110 into the bracket 144. Accordingly, the motor 110 may smoothly drive the piston 120 through the first gear TS1 and the second gear TS2 to reciprocate against the cylinder 140.

Figure 4A:
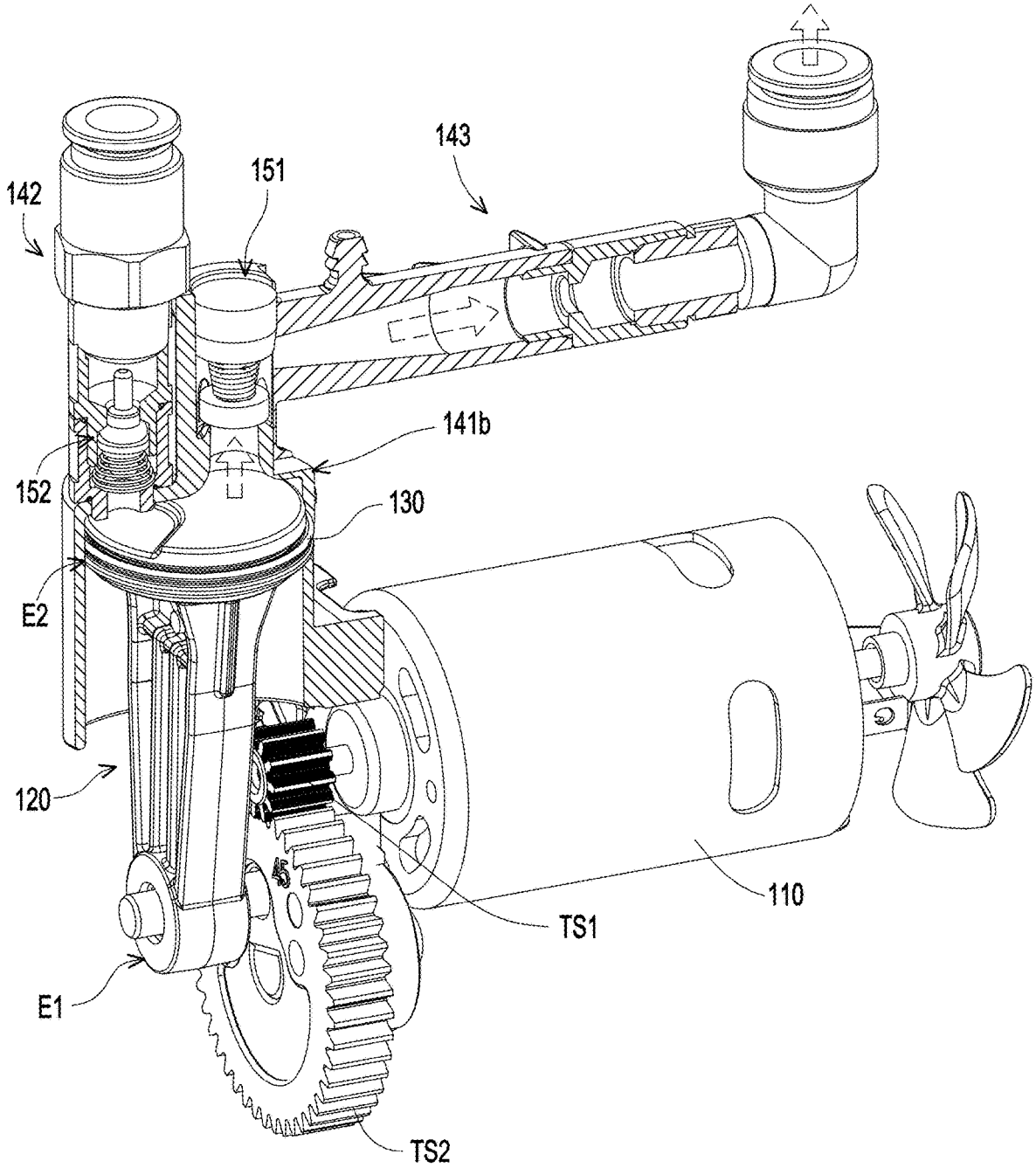
FIG. 4A and FIG. 4B respectively illustrate different states of an air compressor module.
Figure 4B:
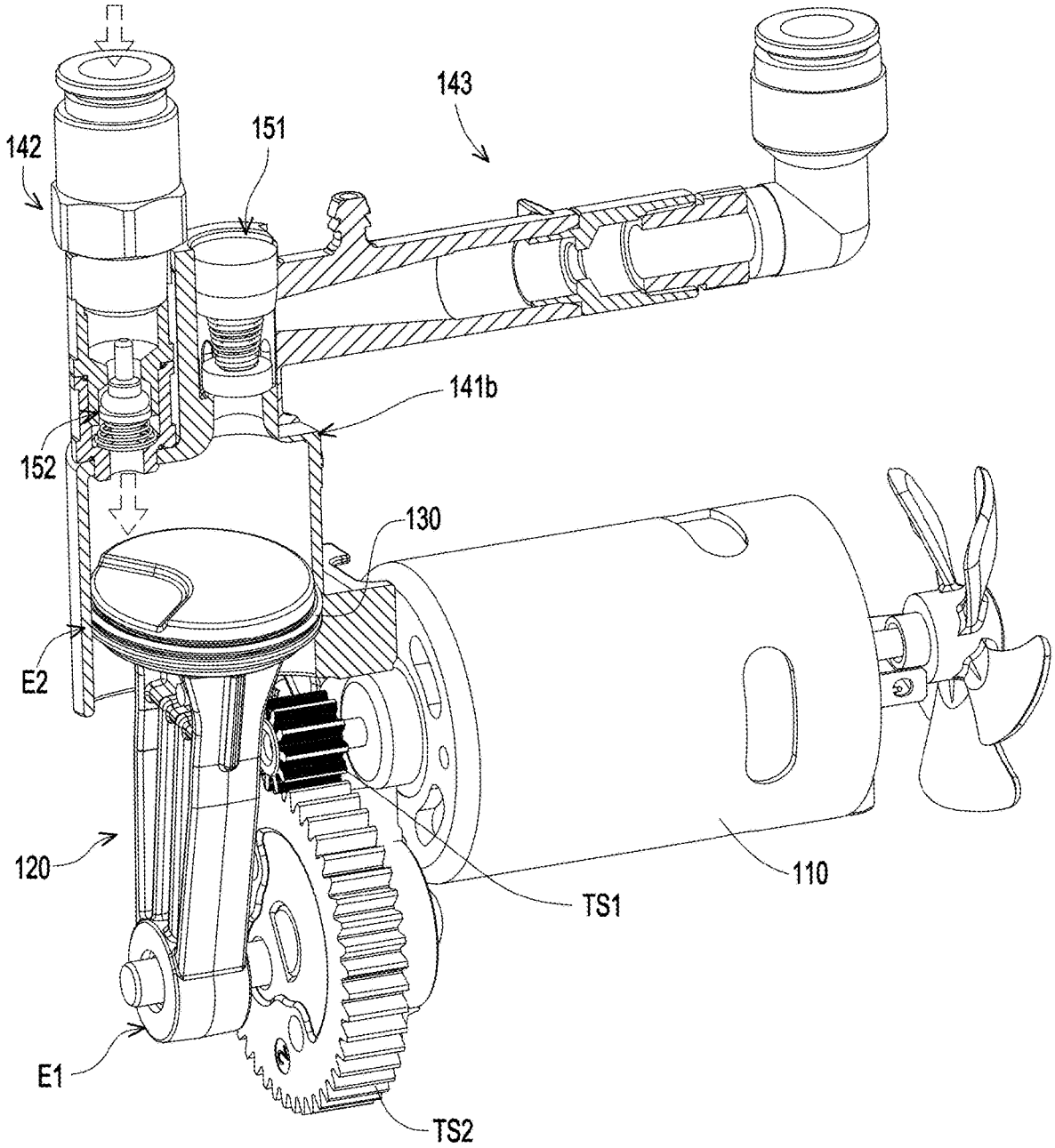

FIG. 4A and FIG. 4B respectively illustrate different states of an air compressor module. Some of the components are sectioned and omitted here to facilitate the identification of correspondences within the components. Please refer to FIG. 3, FIG. 4A, and FIG. 4B at the same time. The cylinder 140 includes a cylinder body 141, a bracket 144, an air inlet pipe 142, and an air outlet pipe 143. The bracket 144, the air inlet pipe 142, and the air outlet pipe 143 each extend from the cylinder body 141. The air inlet pipe 142 and the air outlet pipe 143 are connected to the inner space of the cylinder 140 (i.e., the inner space of the cylinder body 141) and are connected to the exterior environment respectively. The air inlet pipe 142 includes pipe members A1 and A2 and a quick connector A3, and the second check valve 152 is disposed between the pipe members A1 and A2 of the air inlet pipe 142. The air outlet pipe 143 includes pipe members B1 and B2 and a quick connector B3, and the first check valve 151 is disposed in the pipe member B1 of the air outlet pipe 143. Corresponding to FIG. 1 and FIG. 2, the quick connector B3 and the housings 13 and 14 form the air outlet 11 of the main body 10A, and the quick connector A3 and the housings 13 and 14 form the air inlet 12 of the main body 10A. It should be noted that, based on the location of the cylinder body 141, the air outlet pipe 143 and the air inlet pipe 142 are respectively connected to a top portion 141*b* of the cylinder body 141, and a direction of check air flow provided by the first check valve 151 and a direction of check air flow provided by the second check valve 152 are opposite to each other. The first check valve 151 is configured to provide an air outlet direction and block an air inlet direction, and the second check valve 152 is configured to provide the air inlet direction and block the air outlet direction.

In detail, FIG. 4A shows the state after a first stroke of the piston 120. At this time, the second end E2 of the piston 120 moves to the top portion 141*b* of the cylinder body 141 (also equivalent to moving to the air inlet pipe 142 and air outlet pipe 143) and compresses the air inside the cylinder body 141. The compressed air further drives the first check valve 151 to clear a passage of the air outlet pipe 143, so that the compressed air enters the air outlet pipe 143 from the cylinder body 141. If an object is connected to the air outlet 11, the compressed air in the air outlet pipe 143 may be transmitted from the air outlet pipe 143 to the object to inflate the object. At the same time, the second check valve 152 in the air inlet pipe 142 is driven by the compressed air and blocks a passage of the air inlet pipe 142 to prevent the compressed air from being discharged from the air inlet pipe 142 (and the air inlet 12) to the main body 10A of the air compressor.

On the other hand, FIG. 4B shows the state after a second stroke of the piston 120. At this time, for the air inlet pipe 142, the actual residual air in its passage is the same as the exterior environment pressure, and obviously higher than the air pressure inside the cylinder body 141, so the second check valve 152 is further driven to clear the passage of the air inlet pipe 142, so as to allow the air in the exterior environment to enter the cylinder body 141 through the air inlet pipe 142. For the air outlet pipe 143, the pressure of the residual compressed air is significantly greater than the air pressure in the cylinder body 141, so the first check valve 151 is driven to block the air outlet pipe 143 to prevent the compressed air from flowing back into the cylinder body 141. In this way, the air compressor of this embodiment provides a suction effect during the second stroke of the piston 120 and a blowing effect during the first stroke, so that when the piston 120 continues to move in a reciprocal motion, the air compressor may provide blowing and suction functions at the same time.

Figure 4C:
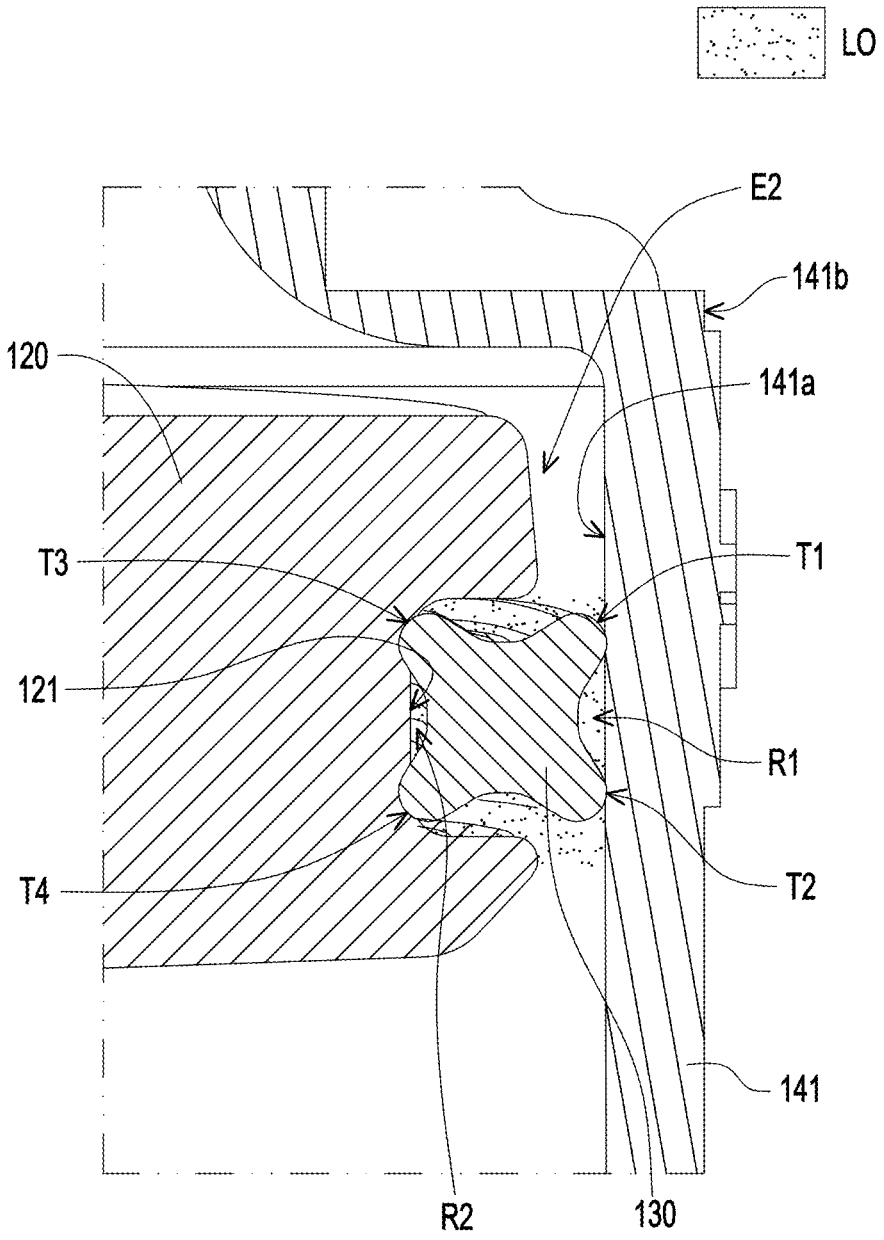
FIG. 4C illustrates a partial enlargement of the air compressor module in FIG. 4A at a second end of a piston.

FIG. 4C illustrates a partial enlargement of the air compressor module in FIG. 4A at a second end of a piston. Please refer to FIG. 3 and FIG. 4C at the same time. In this embodiment, the sealing member 130 is sheathed on an outer wall 121 of the second end E2 of the piston 120, and the second end E2 of the piston 120 is in contact with an inner wall 141*a* of the cylinder body 141 through the sealing member 130. A cross section of the sealing member 130 forms multiple contact zones T1 to T4 on the inner wall 141*a* and the outer wall 121 respectively, and recesses R1 and R2 are formed between two adjacent contact zones T1 and T2 or T3 and T4.

In this embodiment, the sealing member 130 is an X-shaped ring (X-RING) with an X-shaped cross section, two lip portions of which rest against the inner wall 141*a* of the cylinder body 141 to form two contact zones T1 and T2 against the inner wall 141*a*, and accordingly form a recess R1 between the contact zones T1 and T2. At the same time, the other two lip portions are rest against the outer wall 121 of the piston 120, and two contact zones T3 and T4 and a recess R2 located therebetween are formed on the outer wall 121. Because of the multiple contact zones T1 to T4, the sealing member 130 may provide a double sealing function between the piston 120 and the cylinder body 141 while reducing friction and wear due to the flexibility of the lip portions. Furthermore, the air compressor also includes lubricating oil LO, which is coated on the second end E2 of the piston 120 and the sealing member 130. Part of the lubricating oil LO may be stored in the recesses R1 and R2 to ensure long-lasting lubrication and airtightness between the piston 120 and the inner wall 141*a* of the cylinder body 141 when the piston 120 is undergoing reciprocating motion.

Figure 5A:
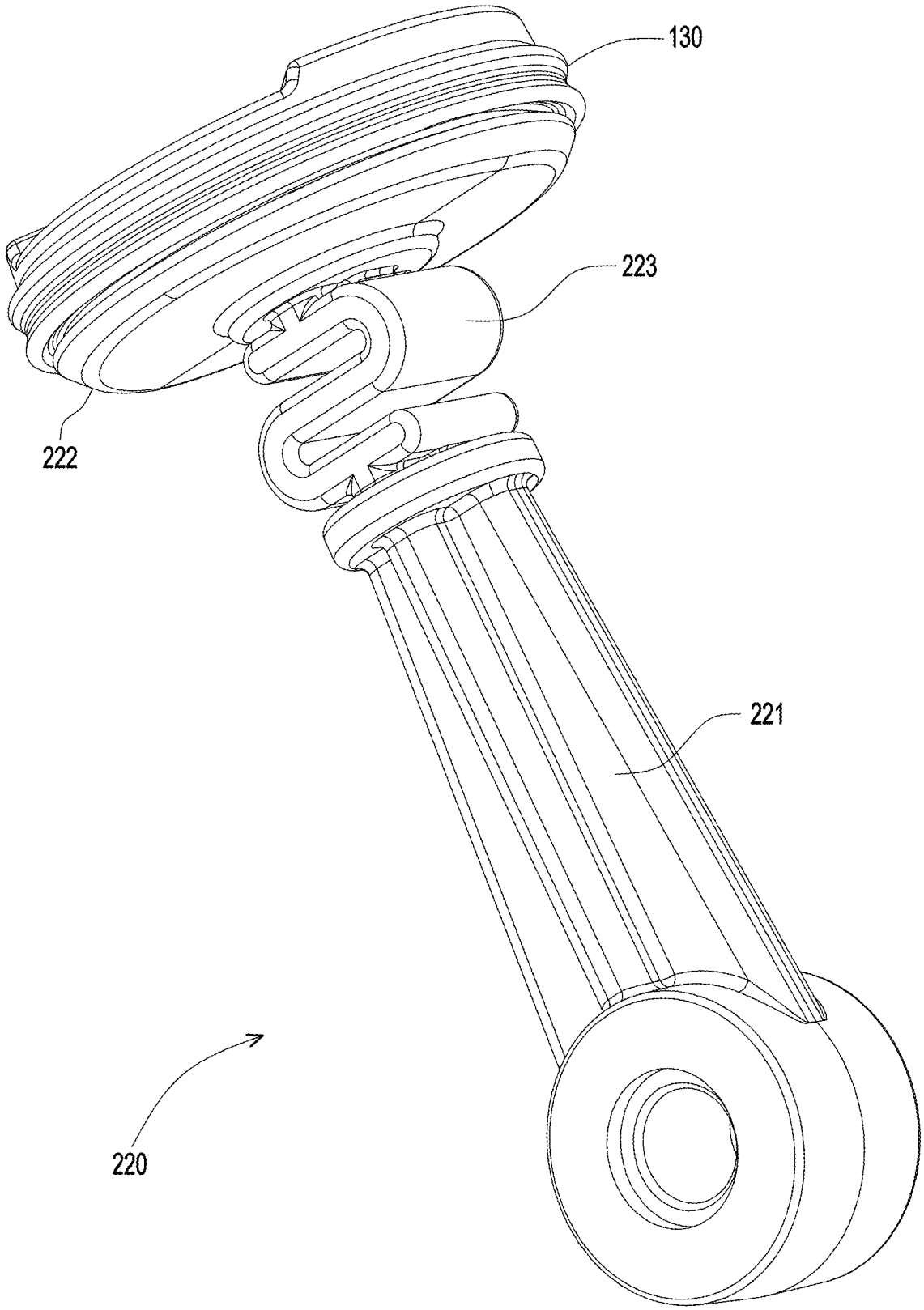
FIG. 5A is a schematic diagram of a piston according to another embodiment of the disclosure.
Figure 5B:
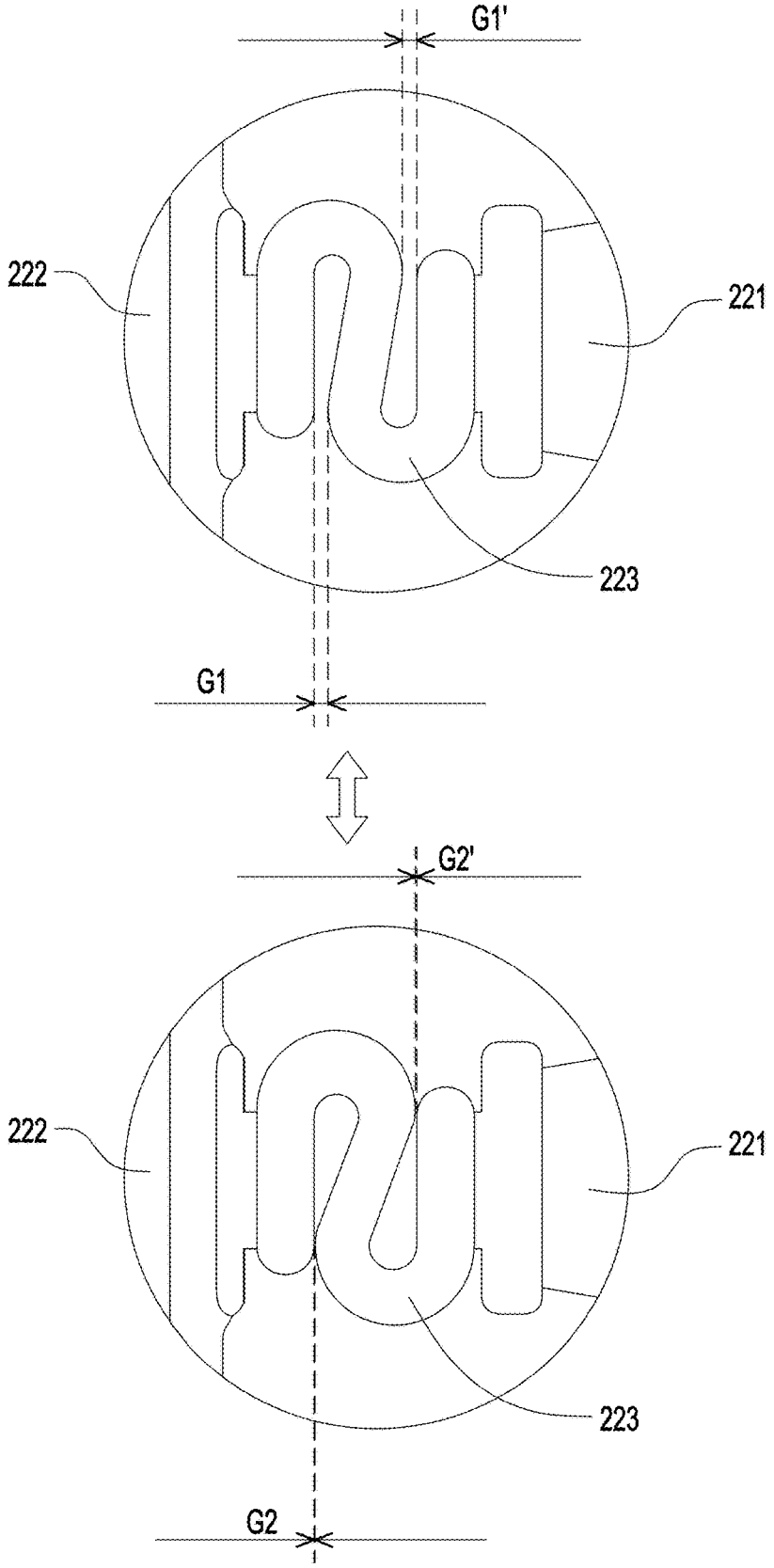
FIG. 5B is a schematic diagram of a portion of FIG. 5A in different states.

FIG. 5A is a schematic diagram of a piston according to another embodiment of the disclosure FIG. 5B is a schematic diagram of a portion of FIG. 5A in different states. It should be noted that since only the structure of the piston is different from the previous embodiment, and the rest of the components, such as the cylinder, are the same as in the previous embodiment, the subsequent description is based on the schematic diagrams of the present embodiment in conjunction with those of the previous embodiment.

Please refer to FIG. 5A and FIG. 5B at the same time. In this embodiment, a piston 220 includes a rod 221, a disk 222, and an elastic member 223. The rod 221 is, for example, a partial structure of the piston 120 having the first end E1, the disk 222 is, for example, a partial structure of the piston 120 having the second end E2, and the sealing member 130 is essentially sheathed on the disk 222. Different from the piston 120 in the previous embodiment, which is an integrally formed structure, this embodiment uses the elastic member 223 to connect between the rod 221 and the disk 222. In this way, by means of the elasticity of the elastic member 223, which allows it to be compressed or resiliently restored by its elasticity, the elastic member 223 serves as a buffer structure between the disk 222 and the rod 221, which are rigid components.

During a first stroke of the piston 220 (e.g., shown in FIG. 4A), the disk 222 is pushed by compressed air under increasing air pressure, which compresses the elastic member 223. As shown in FIG. 5B, a gap G1 of the elastic member 223 is converted to a gap G2 and an elastic force is accumulated. When the piston 220 undergoes a second stroke (e.g., shown in FIG. 4B), the air pressure inside the cylinder body 141 decreases, which also means that the force on the disk 222 decreases, and thus the elastic member 223 resets due to the release of its elastic force. Accordingly, the elastic force accumulated by the elastic member 223 under pressure during the first stroke may be used for the reset of the drive 222 during the second stroke, so as to avoid the sudden increase of air pressure caused by the residual compressed air in the cylinder body 141 when the piston 220 stops moving and restarts, or the sudden increase of air pressure caused by the compressed air from the air outlet pipe 143 flowing back into the cylinder body 141 due to the leakage of the first check valve 151. The presence of the elastic member 223 serves as a buffer for the component to avoid loading or even damage to the component caused by the sudden increase of air pressure.

Figure 6:
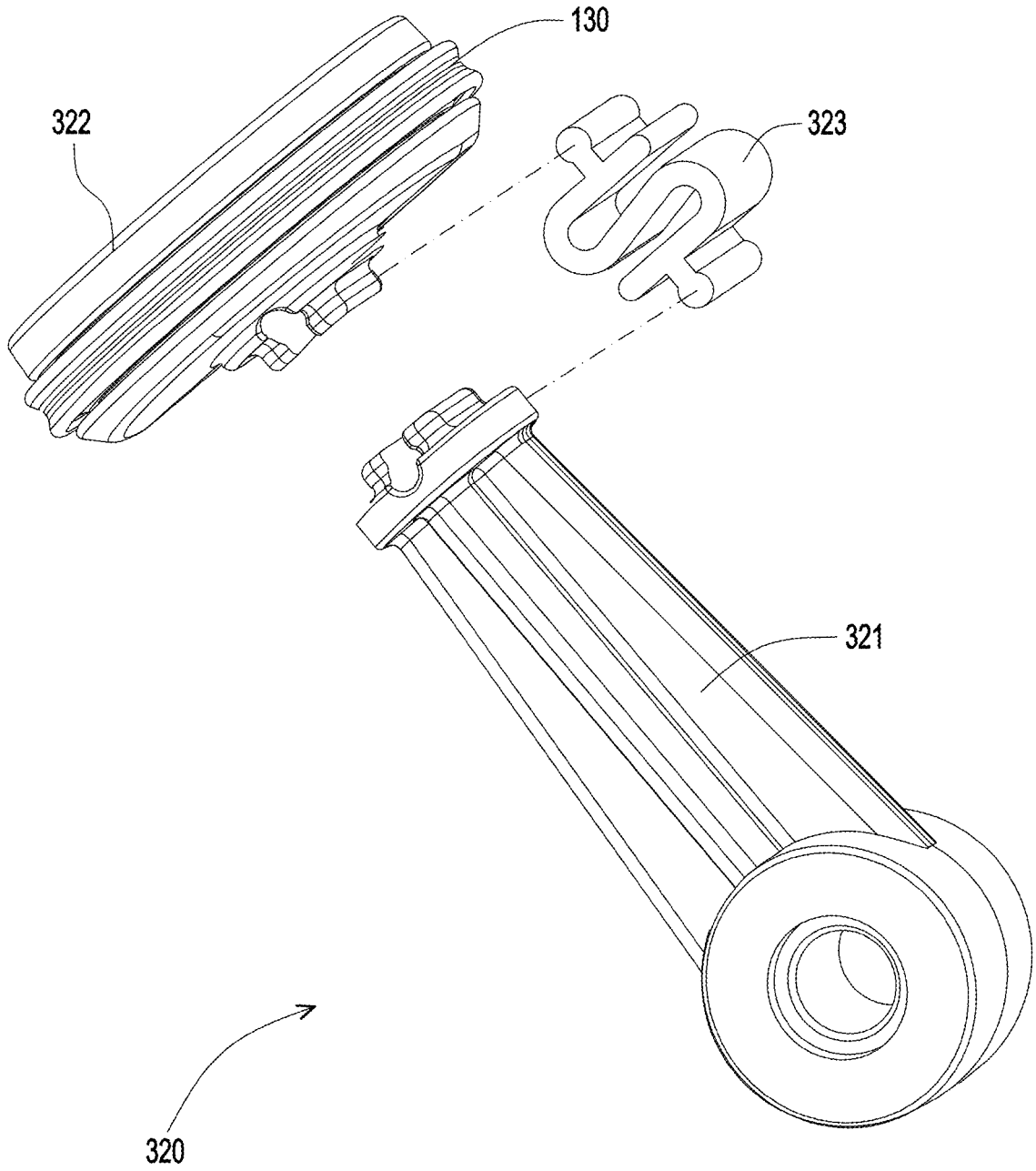
FIG. 6 to FIG. 8 are respectively schematic diagrams of a piston in different embodiments of the disclosure.
Figure 7:
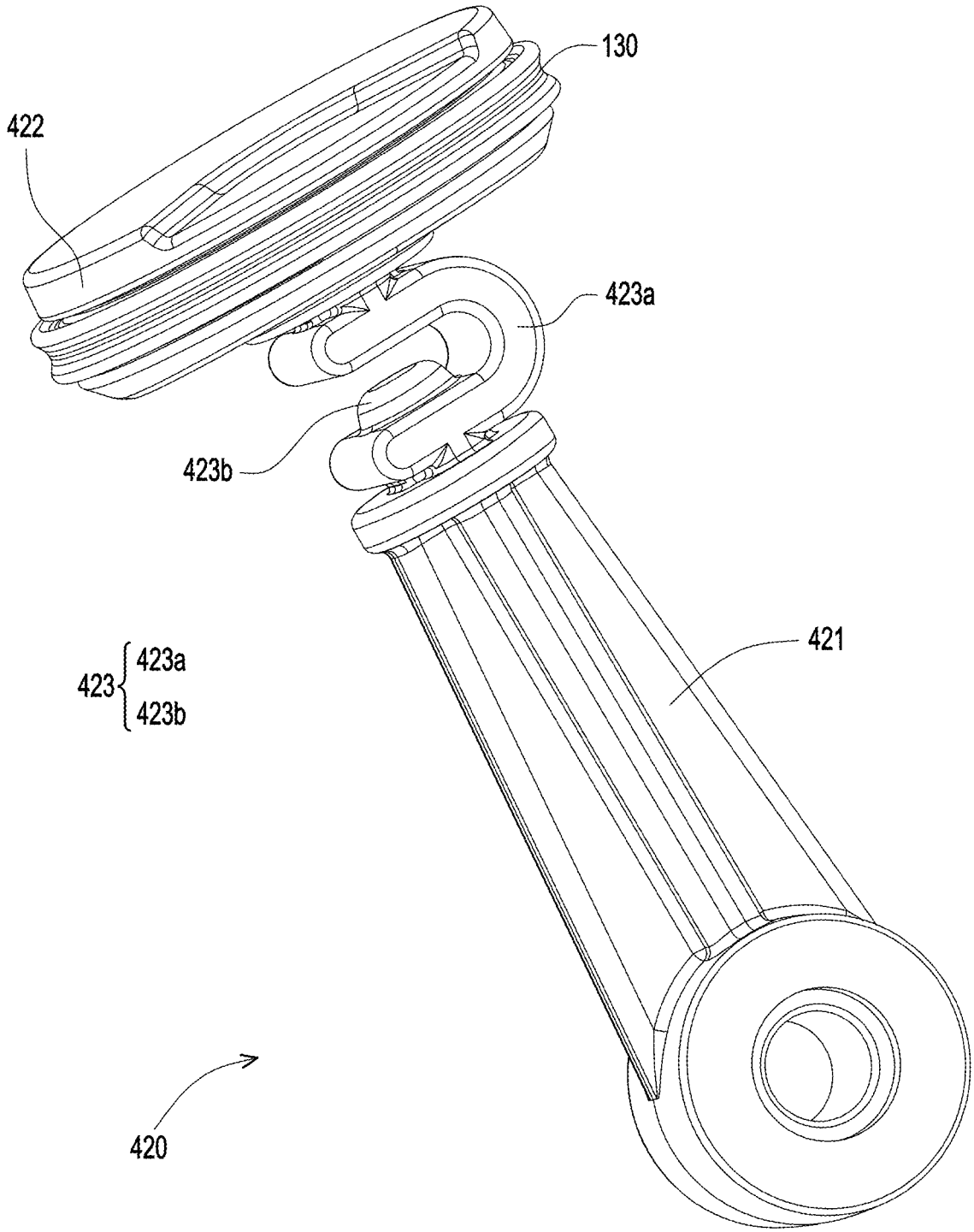
Figure 8:
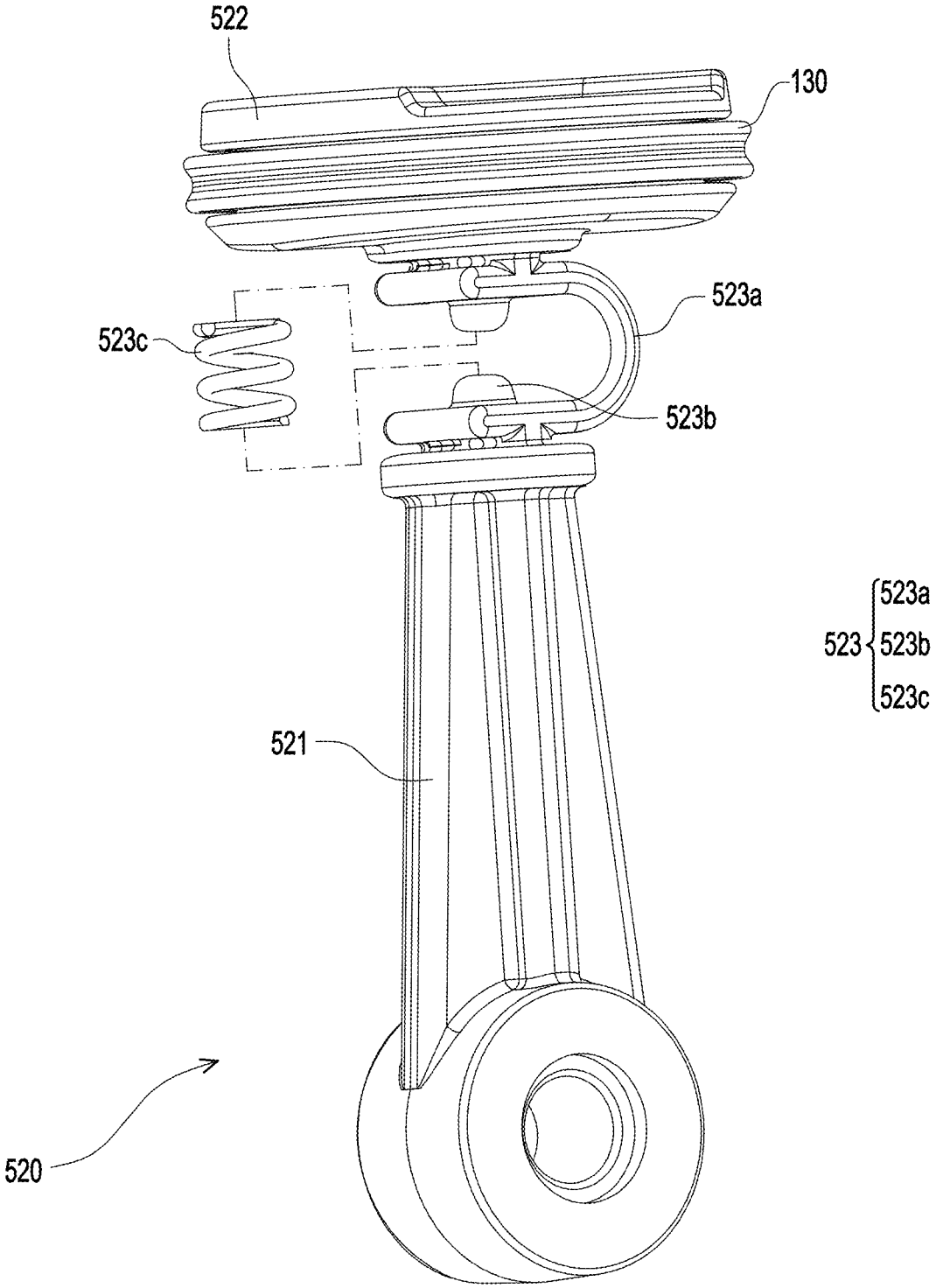

FIG. 6 to FIG. 8 are respectively schematic diagrams of a piston in different embodiments of the disclosure. Please refer to FIG. 6 first. A piston 320 shown includes a rod 321, a disk 322, and an elastic member 323, and the elastic member 323 is detachably fastened to the rod 321 and the disk 322. In other words, the user may replace the elastic member 323 with different elastic coefficients according to needs.

In addition, as shown in FIG. 7, a piston 420 includes a rod 421, a disk 422, and an elastic member 423, and the elastic member 423 includes an elastic portion 423*a* and a fixed portion 423*b*. One end of the elastic portion 423*a* is integrally formed on the disk 422, and the other end of the elastic portion 423*a* is assembled to the rod 421 with the fixed portion 423*b*. The piston 420 of this embodiment provides the elastic member 423, which is different from the aforementioned assembly structure and manufacturing method.

In addition, as shown in FIG. 8, a piston 520 includes a rod 521, a disk 522, and an elastic member 523, and the elastic member 523 includes a first elastic body 523*a*, a fixed portion 523*b* and a second elastic body 523*c*. Opposite ends of the first elastic body 523*a* are respectively assembled to the disk 522 and the rod 521 by the fixed portion 523*b*, and the second elastic body 523*c* further contacts the inside of the first elastic body 523*a* and is thus connected to the disk 522 and the rod 521. More importantly, the elastic coefficient of the first elastic body 523*a* and the elastic coefficient of the second elastic body 523*c* are different from each other. In this way, through the adjustment and matching of the first elastic body 523*a* and the second elastic body 523*c*, the elastic member 523 of this embodiment has a larger adapting range and deformation tolerance.

Figure 9A:
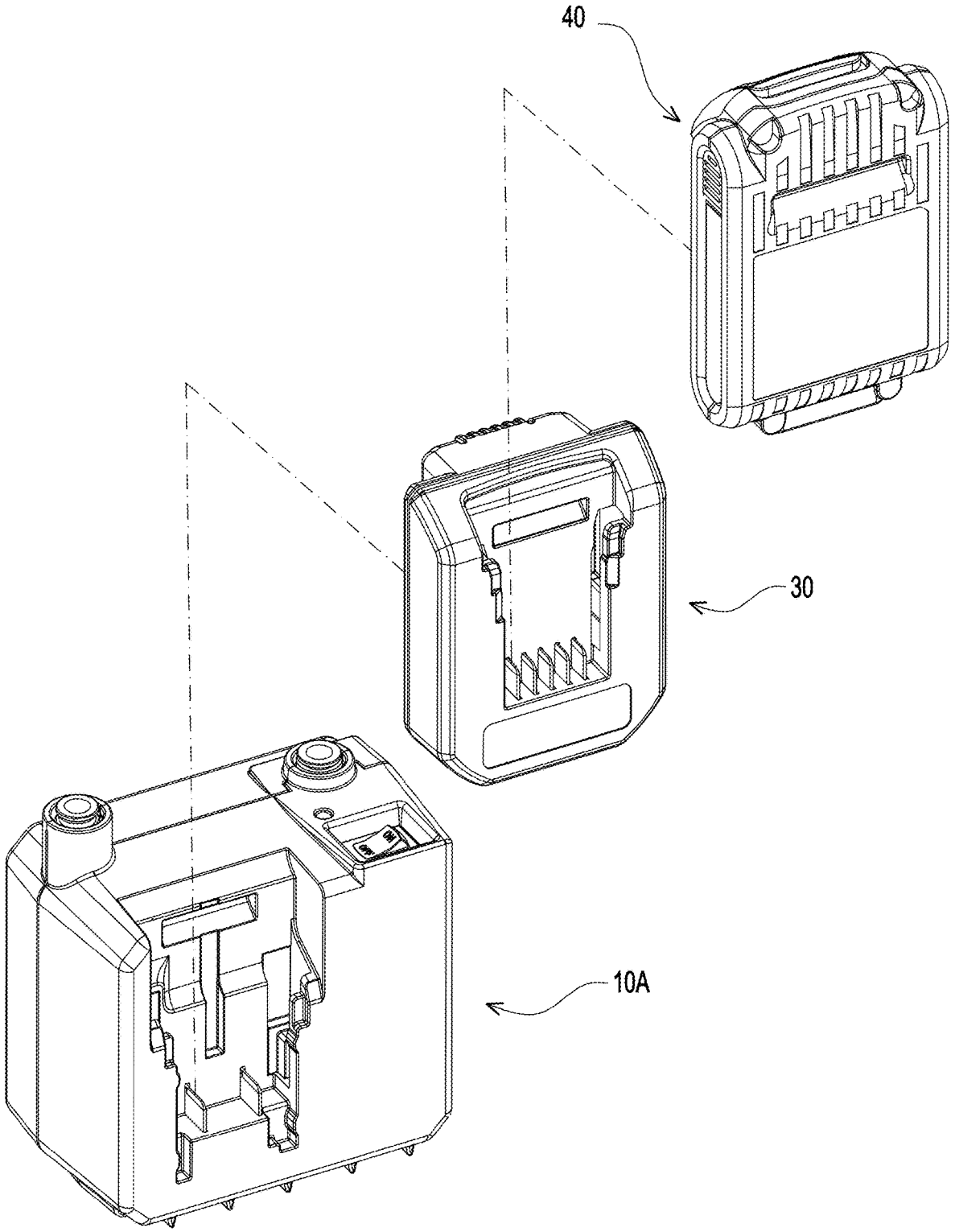
FIG. 9A and FIG. 9B illustrate a schematic diagram of an air compressor according to another embodiment of the disclosure from different viewing angles.
Figure 9B:
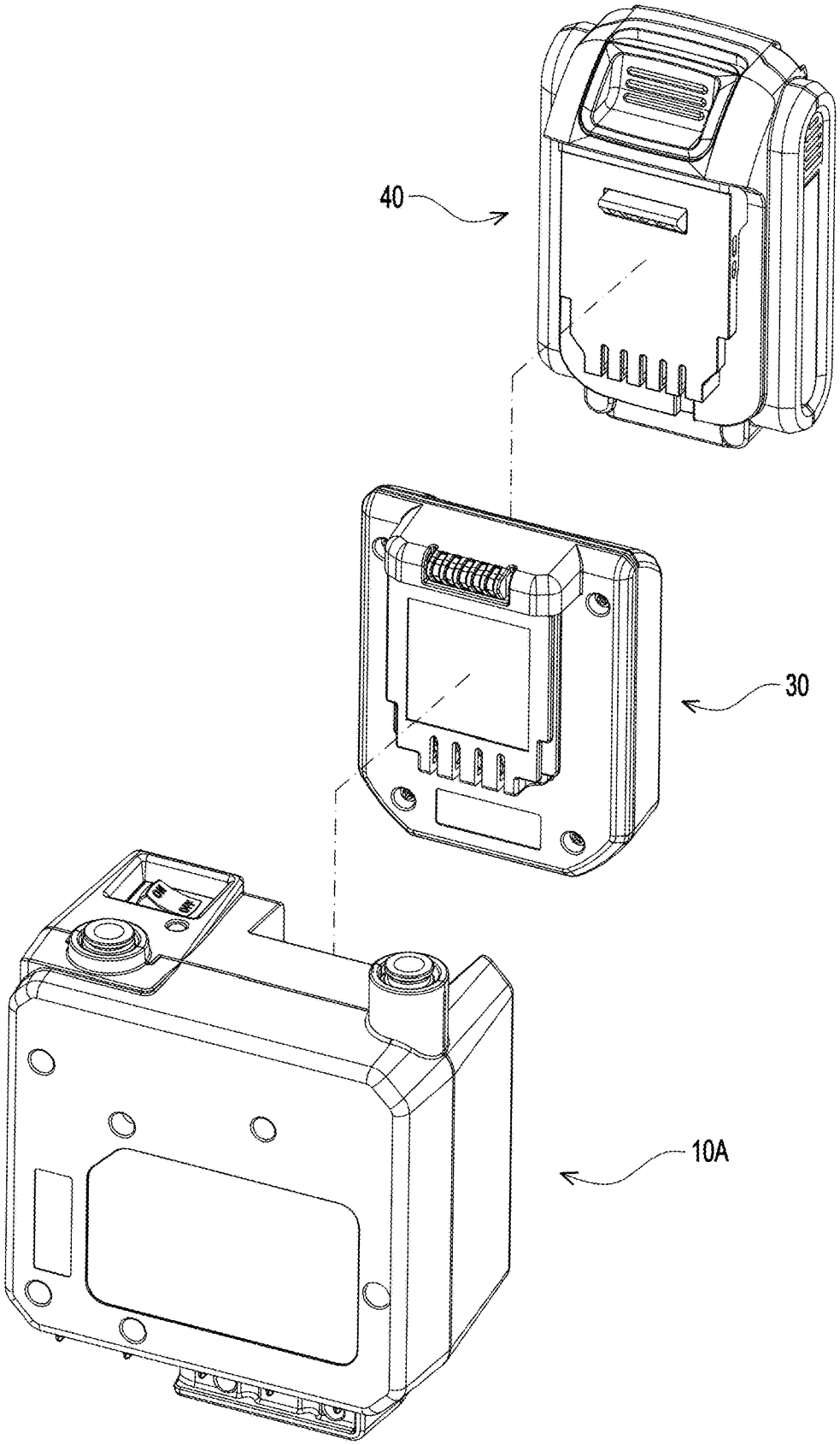

FIG. 9A and FIG. 9B illustrate a schematic diagram of an air compressor according to another embodiment of the disclosure from different viewing angles. Please refer to FIG. 9A and FIG. 9B. Different from the main body 10A of the embodiment shown in FIG. 1, which is directly equipped with the battery 20, the air compressor of this embodiment is configured with a plug adapter 30 and a battery 40. The reason is that with the advancement of battery technology, different models or new and old models are bound to face situations where the sizes or specifications do not match and cannot be used. Accordingly, in this embodiment, the plug adapter 30 may be plugged into a slot of the main body 10A, and then the battery 40 of the same size or specification as the battery 20 may be used, thus increasing the applicability of the air compressor.

Figure 10:
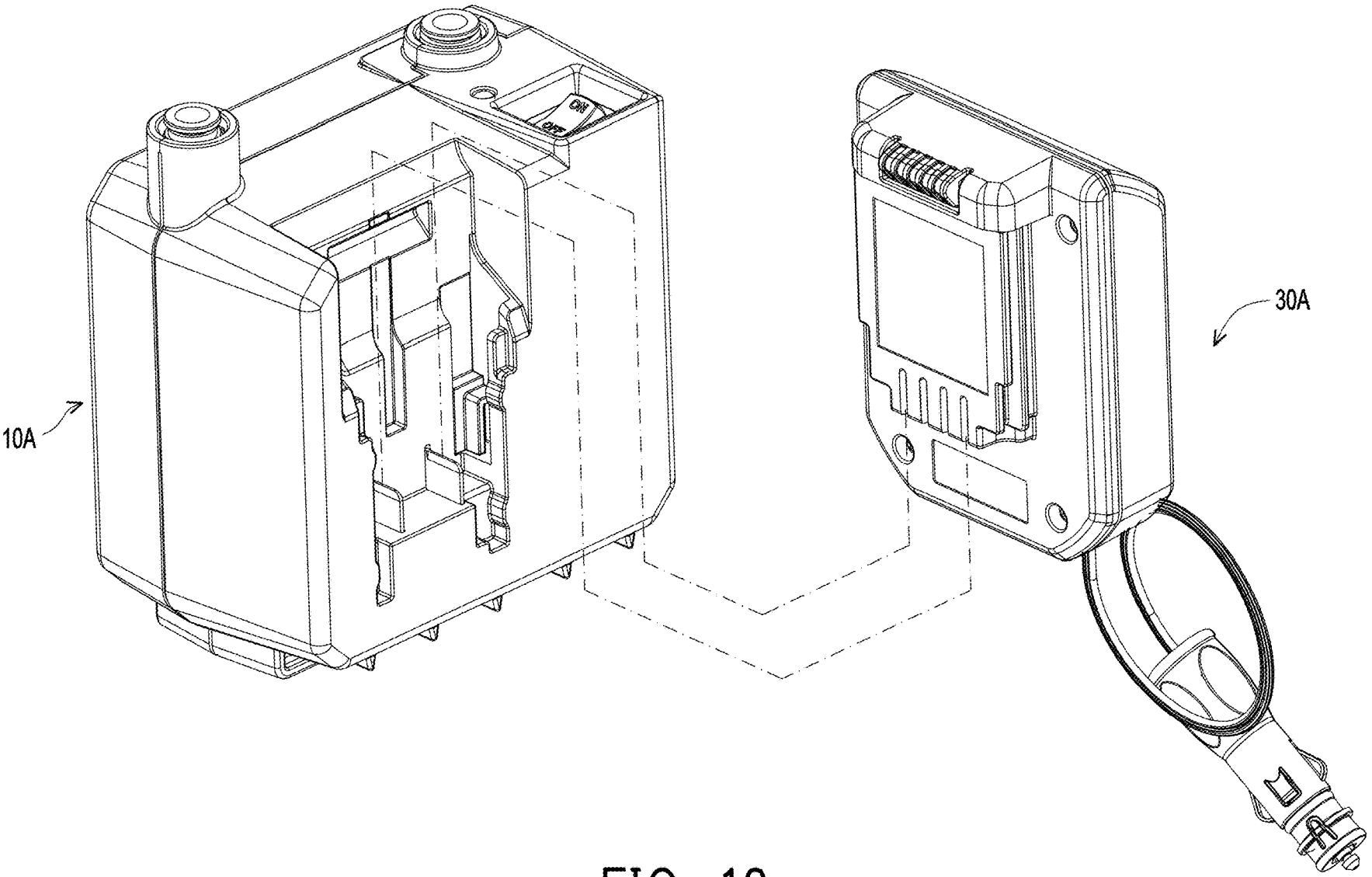
FIG. 10 is a schematic diagram of an air compressor according to another embodiment of the disclosure.

FIG. 10 is a schematic diagram of an air compressor according to another embodiment of the disclosure. Please refer to FIG. 10. Different from FIG. 9A and FIG. 9B, the battery 40 is used to power the main body 10A. In this embodiment, a plug adapter 30A equipped with a cable may be plugged into the slot of the main body 10A, and the main body 10A is powered by an external power supply (not shown) through the plug adapter 30A.

To sum up, in the above embodiments of the disclosure, the air compressor utilizes the reciprocating motion of the piston in the cylinder with the first check valve and the second check valve to generate the dual effect of blowing and sucking air flow in different pipelines. Furthermore, the sealing member is sheathed on the piston and abutted to the inner wall of the cylinder. Here, the cross section of the sealing member forms multiple contact zones on the inner wall and the outer wall of the piston respectively, and a recess is formed between two adjacent contact zones. In this way, the airtightness between the piston and the inner wall of the cylinder may be increased during piston movement.

Furthermore, the piston is further equipped with elastic member between the rod and the disk to act as a buffer structure between the rigid components, so as to avoid the sudden increase in air pressure from burdening or even damaging the components. In addition to being equipped with a battery to increase its portability, the air compressor may also be adapted to batteries of different sizes or specifications through a plug adapter, and may be equipped with a plug adapter with a cable to allow external power supply to the main body of the air compressor.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A portable blowing and suction air compressor, comprising:

a motor;

a piston, having a first end and a second end opposite to each other, the first end being connected to the motor;

a sealing member, sheathed on an outer wall of the piston at the second end;

a cylinder, wherein the second end of the piston is movably coupled to the cylinder, and the second end is in contact with an inner wall of the cylinder through the sealing member, wherein a cross section of the sealing member forms a plurality of contact zones on the inner wall and the outer wall respectively, a recess is formed between two adjacent one of the contact zones, and the cylinder has an air inlet pipe and an air outlet pipe connected to an inner space of the cylinder and connected to an exterior environment respectively;

a first check valve, disposed in the air outlet pipe; and a second check valve, disposed in the air inlet pipe, wherein the motor drives the piston to reciprocate in the cylinder, during a first stroke, the piston compresses air in the cylinder, the compressed air drives the first check valve to clear a passage of the air outlet pipe to enter the air outlet pipe, and the compressed air drives the second check valve to block a passage of the air inlet pipe, and during a second stroke, the piston reduces air pressure in the cylinder, the compressed air in the air outlet pipe or air in the exterior environment drives the first check valve to block the passage of the air outlet pipe, and the air in the exterior environment or the air in the air inlet pipe drives the second check valve to clear the passage of the air inlet pipe to enter the cylinder through the air inlet pipe, wherein the piston comprises a rod, a disk, and an elastic portion, the rod has the first end, the disk has the second end, and the elastic portion is connected between the rod and the disk.

2. The portable blowing and suction air compressor according to claim 1, wherein the sealing member is an X-shaped ring, and forms two contact zones on the inner wall and the outer wall respectively and the recess located between the two contact zones.

3. The portable blowing and suction air compressor according to claim 1 further comprising lubricating oil coated on the second end of the piston and the sealing member, wherein part of the lubricating oil is stored in the recess.

4. The portable blowing and suction air compressor according to claim 1 further comprising a main body, the motor, the piston, the sealing member, the cylinder, the first check valve, and the second check valve are accommodated in the main body, the air outlet pipe forms an air outlet at an end far away from the cylinder with a part of the main body, and the air inlet pipe forms an air inlet at an end far away from the cylinder with another part of the main body.

5. The portable blowing and suction air compressor according to claim 4 further comprising a battery pluggably disposed in a slot on the outside of the main body.

6. The portable blowing and suction air compressor according to claim 4 further comprising a battery and a plug adapter, wherein the plug adapter is pluggably disposed in a slot on the outside of the main body, and the battery is pluggably disposed in another slot of the plug adapter.

7. The portable blowing and suction air compressor according to claim 4 further comprising an adapter pluggably disposed in a slot on the outside of the main body, wherein the adapter is electrically connected to an external power supply through a cable.

8. The portable blowing and suction air compressor according to claim 1, wherein the elastic portion is detachably fastened to at least one of the rod and the disk.

9. The portable blowing and suction air compressor according to claim 1, wherein the elastic portion comprises a first elastic body and a second elastic body respectively connected between the rod and the disk, the second elastic body is nested inside the first elastic body, and an elastic coefficient of the first elastic body and an elastic coefficient of the second elastic body are different from each other.

* * * * *